US007213633B2

(12) United States Patent
Petronzio

(10) Patent No.: US 7,213,633 B2
(45) Date of Patent: May 8, 2007

(54) METHOD OF FORMING SCALLOPED CONFIGURATION IN CURTAINS

(76) Inventor: Frank Petronzio, 54 Starlight Rd., W. Milford, NJ (US) 07480

( * ) Notice: Subject to any disclaimer, the term of this patent is extended or adjusted under 35 U.S.C. 154(b) by 79 days.

(21) Appl. No.: 10/880,475

(22) Filed: Jul. 1, 2004

(65) Prior Publication Data

US 2005/0211399 A1 Sep. 29, 2005

Related U.S. Application Data

(60) Provisional application No. 60/555,921, filed on Mar. 24, 2004.

(51) Int. Cl.
*E06B 9/56* (2006.01)

(52) U.S. Cl. ..... 160/330; 160/349.2

(58) Field of Classification Search ..... 160/349.2, 160/348, 330, 84.01, 349.1; 135/117; D6/578
See application file for complete search history.

(56) References Cited

U.S. PATENT DOCUMENTS

| | | | | | |
|---|---|---|---|---|---|
| 928,190 | A * | 7/1909 | Flynn | 248/263 |
| 4,265,261 | A * | 5/1981 | Barker | 135/100 |
| D273,452 | S * | 4/1984 | Ackerman | D6/578 |
| 2003/0116287 | A1 * | 6/2003 | Titus et al. | 160/348 |
| 2005/0252617 | A1 * | 11/2005 | Hsu | 160/84.01 |

* cited by examiner

*Primary Examiner*—Blair M. Johnson

(57) ABSTRACT

A method of forming scalloped configuration in a single or double-layer curtain comprises providing the curtain with a pair of ties with their upper ends attached to the curtain and their lower ends hanging freely. A solid bead having a passageway therethrough is slipped upwardly through each tie to approximately the same height until a scalloped configuration is formed in the curtain.

8 Claims, 4 Drawing Sheets

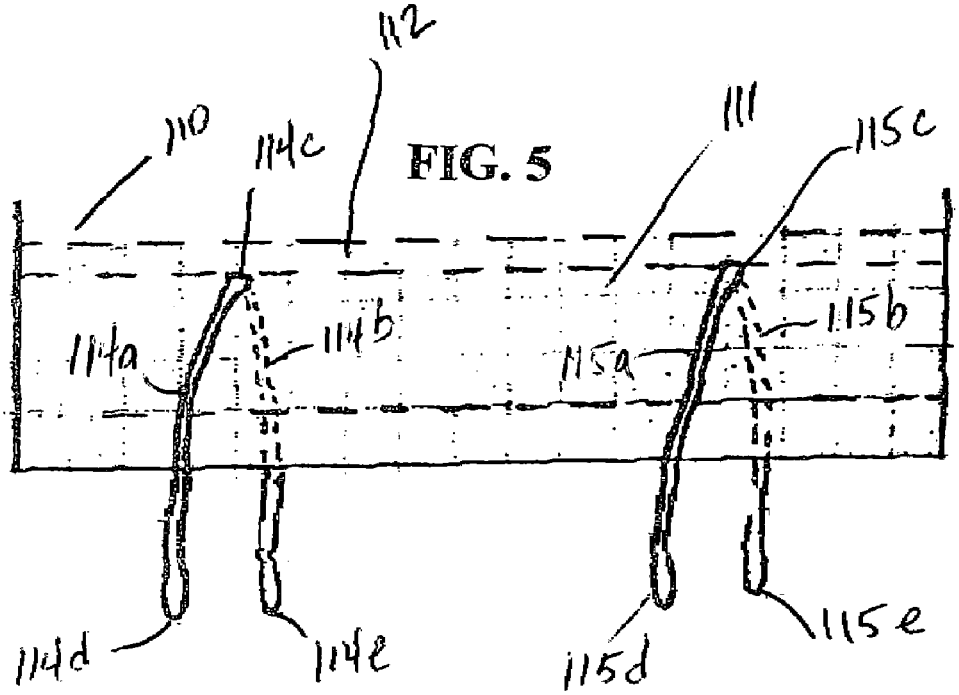
FIG. 5
FIG. 8
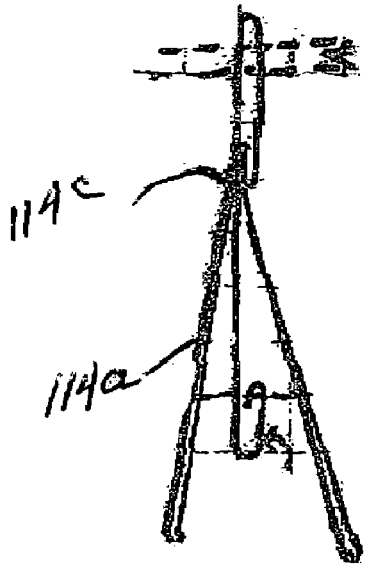

METHOD OF FORMING SCALLOPED CONFIGURATION IN CURTAINS

RELATED PATENT APPLICATIONS

This application is related to provisional patent application Ser. No. 60/555,921 filed Mar. 24, 2004.

FIELD OF THE INVENTION

This invention relates generally to swaging curtains and draperies and is specifically related to a method of forming scalloped configuration in curtains and draperies used for hanging from windows, thus imparting desired decorative and aesthetic appearance thereto. More specifically, this invention provides such method in an extremely simple, effective and quick manner.

BACKGROUND OF THE INVENTION

Curtains and draperies are frequently used to hang from windows and it is often desirable to gather the curtain material into folds for decorative and aesthetic effects. Gathering the curtain materials into decorative folds and fixing it into position can be accomplished by hand, but needless to say that is cumbersome and time consuming task. The difficulty is exacerbated when it is desired to hand decorative curtains from high windows such as theatres, art galleries or over large windows at homes.

Several prior art patents describe different methods of handing draperies for hanging from windows. An early patent, i.e., Design Pat. No. 14,621 issued Feb. 5, 1884 shows a design for a lambrequin wherein an upper portion shapes two festoons over the lower portion, and has two ends falling below the sides of the lower portion.

U.S. Pat. No. 2,668,587 issued Feb. 9, 1954 describes and illustrates a class of draped window curtains having a "tie back" construction which forms an integral part of the curtain as shown in FIGS. 1 and 3.

U.S. Pat. No. 2,671,508 issued Mar. 9, 1954 describes improvements in hanging draperies. To a valance drapery made from a piece of rectangular material are secured eyelets arranged along parallel lines running longitudinally of the material thereby forming folds or pleats when the eyelets are threaded together.

U.S. Pat. No. 3,001,579 issued Sep. 26, 1961 describe the use of swaging tape which is applied to the material to be gathered, the tape being applied to the drapery material by sewing or stitching operation.

None of the previously described prior art methods of other known methods provide a simple, effective and inexpensive method of gathering the drapery material in order to form a desired scalloped configuration as is possible by the method of this invention.

Therefore, it is the object of this invention to provide a method of gathering drapery material to form a scalloped configuration for hanging the drapery over a window.

It is a further object of this invention to provide a method of forming a scalloped-shaped design in draped curtains while the curtain is hanging from a window.

It is also an object of the present invention to provide such method which can readily be used in homes with simplicity and efficiency at minimal costs.

The foregoing and other objects of this invention will become more apparent from the ensuing detailed description and with reference to the accompanying drawings.

SUMMARY OF THE INVENTION

The present invention provides a method for forming scalloped configuration in single layer or multi-layer (e.g., double layer) curtains. A double layer curtain comprises a front panel and a back panel with each panel being defined by an upper edge and a lower generally parallel edge, and two generally parallel sides. In applying the method of this invention to such curtains, the curtain is provided with two pairs of spaced apart ties, each tie having an upper end conjointly attached to one of said panels a finite distance from the top edge and its respective side edge, and are freely hanging at their lower ends. A solid object such as a bead, which may be spherical in shape, and has a channel or passageway extending through the bead, is slipped through each pair of ties and the bead is raised until a scalloped configuration is formed which is discernible by visual observation. At that point, the ends of the ties are bowed to prevent the beads from falling down and remain in their scalloped configuration position. By untying the bows, the beads may be slipped down through the ties and the curtain will return to its original position.

BRIEF DESCRIPTION OF THE DRAWINGS

Referring to the different figures in the drawings wherein like reference numerals are used to designate like parts;

FIGS. 5–8 are views corresponding to FIGS. 1–4, respectively, for a single-layer curtain.

DETAILED DESCRIPTION OF THE INVENTION

Figure 1:
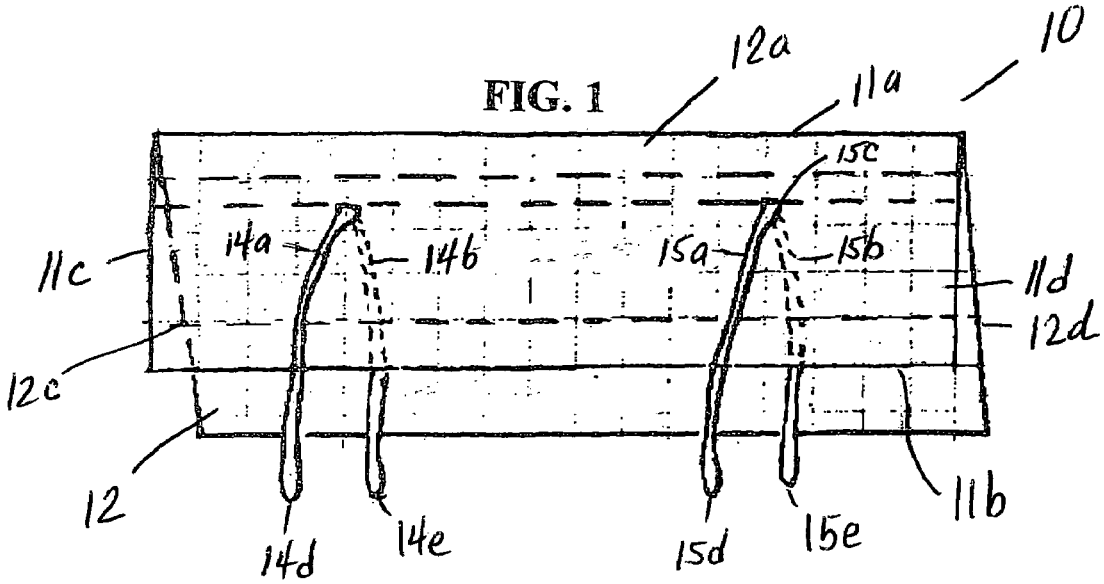
FIG. 1 is a front view of a double-layer curtain having a front layer or panel and a back layer or panel with two pairs of ties as shown and hereinafter described.
Figure 4:
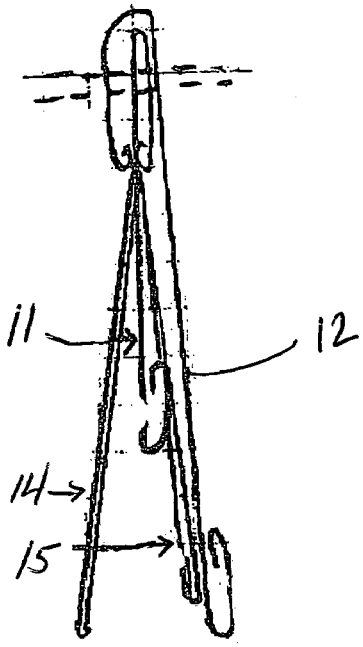
FIG. 4 is a side view of FIG. 2.

Referring first to FIG. 1, there is shown a curtain 10 comprising a front layer or panel 11 and a back layer or panel 12 stitched or sewn together along the top of each panel to form a channel or passageway 13 for the insertion of a curtain rod (not shown) therethrough for hanging the curtain from a window. The panel 11 is defined by the longitudinal, generally parallel top and bottom edges 11*a* and 11*b*, a generally vertical left side edge 11*c* and right generally parallel side edge 11*d*. Also, the back panel 12 is defined by similar top and bottom edges 12*a*, 12*b* and similar side edges 12*c*, 12*d*. A pair of ties 14*a*, 14*b* (e.g., ribbons or bands made from the same or different material as the curtain) are attached or sewn to the curtain at their conjoint ends such as at 14*c*, a finite desired distance from the top edge and left side of the curtain panel, and are normally freely hanging at their lower ends 14*d*, 14*e*. A similar pair of ties 15*a*, 15*b* are also attached or sewn to the curtain at their conjoint ends such as at 15*c*, a finite desired distance from the top edge and right edge of the curtain panel, and are normally freely hanging at their lower ends 15*d*, 15*e*. Preferably the conjoint ends 14*c* and 15*c* lie on a common line 16 which is generally parallel to the top and bottom edges, and the distance between each conjoint end 14*c* and 15*c* from their respective sides and edges are approximately equal in order to form the desired scalloped design as herein described.

Figure 2:
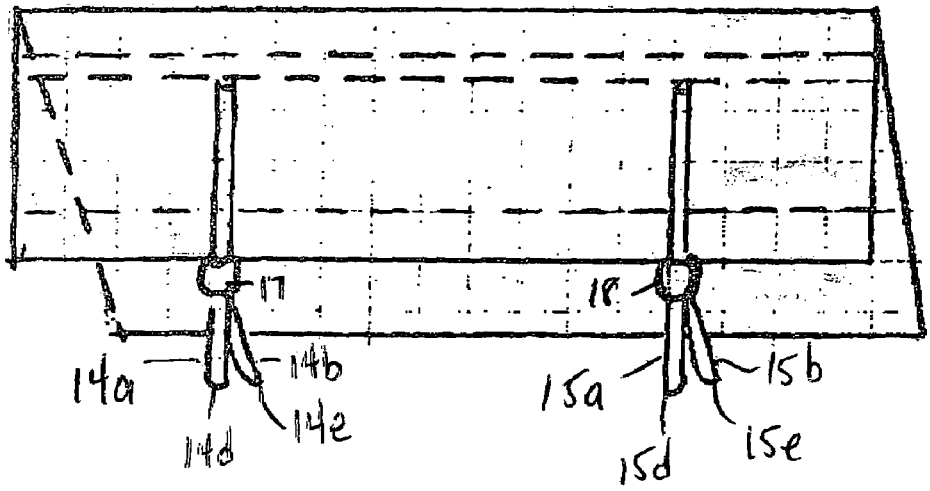
FIG. 2 is a view similar to FIG. 1 with each pair of ties is inserted through a spherical bead having a channel for passage of the ties therethrough, wherein the ties are in initial free-hanging positions.
Figure 3:
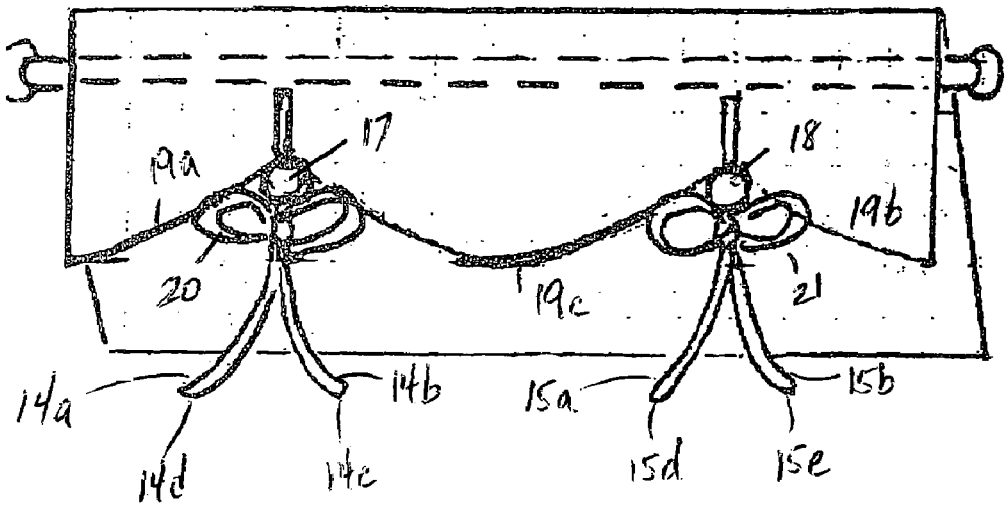
FIG. 3 is a front view similar to FIG. 2 but wherein the beads are raised to form the desired scalloped design in the curtain.
Figure 6:
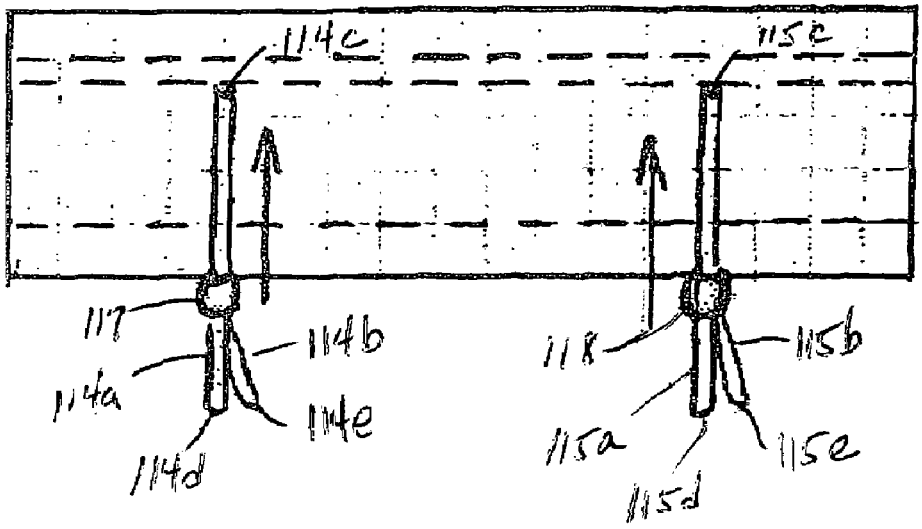
Figure 7:
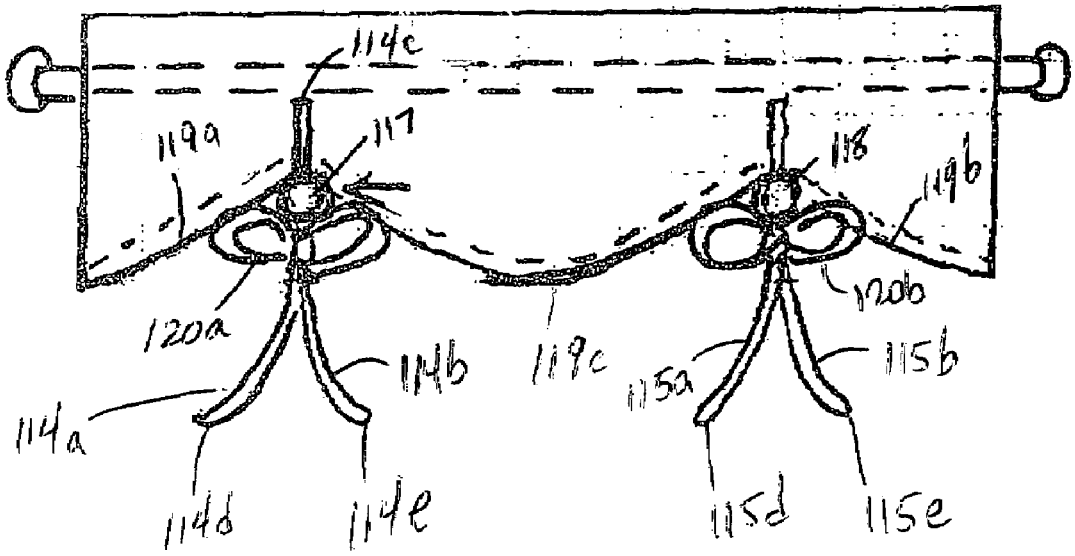

Referring to FIG. 2, there is shown the beads 17 and 18; one for each pair of ties. Each bead is usually spherical or round in shape having a central passageway extending centrally therethrough, between the top and bottom of the bead for insertion and passage of each pair of said ties through each bead. The width or diameter of the passageway must of course be large enough to accommodate the pair of ties such that the bead can be slidably raised and lowered as desired.

In order to form the desired scallop design in the curtain panels, the ties 14*a*, 14*b* are inserted through the passageway in the bead 17 and the bead 17 is raised to the desired height until it results in the formation of part of the scalloped design 19*a* at which point the ties or ribbons may be tied into a bow as in 20*a*. Similarly, the ties 15*a*, 15*b* are slipped through the passageway in the bead 18 and bead 18 is raised to the desired height, which is usually equal to the height to which the bead 17 is raised, to form the other part of the scalloped design 19*b* and the ties are then bowed as in 20*a* after forming of the scalloped design 19*a*, 19*b*, 19*c*, the ties are bowed as aforesaid remain raised while the curtain is hanging from the window. In order to remove the curtain, such as for cleaning, the bows are untied and the beads are slipped down to their initial positions. The scalloped design may result in ruffled or gathered portions, if desired, for improved aesthetic appearance. Thus, a quick and simple method is provided for forming scalloped designs in a curtain which does not require the complicated and time-consuming operation normally required for forming the desired curtain designs.

The method of formation of scalloped design for a mono-layered curtain is described by reference to FIGS. 5–8 of the drawings. In FIG. 5 the curtain 110 is formed by a single layer or panel 111 having an overlapped and stitched or sewn top segment which forms a passageway 112 for the passage of a curtain rod (not shown). The panel 111 is defined by the top, and lower generally parallel edges 111*a*, 111*b*, and generally parallel side edges 111*c*, 111*d*. A pair of ties 114 and 114*b* (e.g., ribbons or bands made from the same or different material as the curtain) are attached or sewn to the panel 111 at their conjoint ends such as 114*c*, a finite desired distance from the top edge and left side of said panel, and are normally freely hanging at their lower ends 14*d*, 14*e*. A similar pair of ties 115*a*, 115*b* are also attached or sewn to the panel 111 at their conjoint point 115*c*, a finite desired distance from the top edge and left side of said panel, and are normally freely hanging at their lower ends 115*d*, 115*e*. Preferably the conjoint ends 114*c* and 115*c* lie on a common line 116 which is generally parallel to the top and bottom edges, and the distances between each conjoint end 114*c* and 115*c* from its respective sides and edges are approximately equal in order to form the desired scalloped configuration in the curtain panel.

The method of forming the scalloped design in the single layer curtain panel 111 is the same as hereinbefore described for the double-layer curtain, using the beads 117, 118 each of which has a central passageway extending between the top and bottom of each bead. As in the double layer curtain, in order to form the scalloped configuration in the single layer curtain, each pair of ties is passed through the passageway of each bead, each bead is raised by slipping up to the desired height until forming the scalloped configurations defined by the curtain panel segments 119*a*, 119*b* and 119*c*, and each pair of ties may be bowed as in 120 and 121. Once again the scalloped design may result in gathered or ruffled portion which enhances the aesthetic view of the curtain.

Although a spherical bead is used in the method described herein, the shape of the bead is not critical, per se, so long as the bead is provided with a through passage for insertion of the ties such that the bead can be manipulated by sliding it through and up to the desired height in the curtain. Other changes and modifications are suggested from the foregoing detailed description without departing from the scope of the present invention.

The invention claimed is:

1. A method of forming scalloped configuration in a double-layer curtain for hanging from windows, said curtain having a front layer and a back layer, each of said layers being defined by an upper edge and a lower generally parallel edge, and two generally parallel sides, said method comprising:

(c) providing two pairs of ties, each tie having an upper end attached to said curtain, and a freely hanging lower end, (c) each of said pairs of ties being attached at their upper ends to one of said curtain layers a finite distance from the top edge and its respective side edge, and (c) slipping each pair of said ties a through solid bead having a passageway therethrough for passage of said ties and raising each bead to approximately the same height until forming the scalloped configuration in said curtain.

2. A method as in claim 1 wherein each of said beads is spherical in shape having a central through passageway.

3. A method as in claim 1 wherein the ends of each pair of ties which are attached to the curtain lie on a common line which is generally parallel to the top and bottom edges of each of said layers.

4. A method as in claim 2 wherein the ends of each pair of ties which are attached to the curtain lie on a common line which is generally parallel to the top and bottom edges of each of said layers.

5. A method of forming a scalloped configuration in a single layer curtain, said curtain layer being defined by an upper edge and a lower generally parallel edge, and two generally parallel side edges, said method comprising:

(a) providing two pairs of ties, each tie having an upper end attached to said curtain, and a freely hanging lower end, (b) each of said pairs of ties being attached at their upper ends to said curtain a finite distance from the top edge and respective side edge, and (c) slipping each pair of said ties through a solid bead having a passageway therethrough for passage of said ties and raising each bead to approximately the same height until forming the scalloped configuration in said curtain.

6. A method as in claim 5 wherein each of said beads is spherical in shape having a central through passageway.

7. A method as in claim 5 wherein the ends of each pair of ties which are attached to the curtain lie on a common line which is generally parallel to the top and bottom edges of each of said layers.

8. A method as in claim 6 wherein the ends of each pair of ties which are attached to the curtain lie on a common line which is generally parallel to the top and bottom edges of each of said layers.

* * * * *